US010415298B2

(12) United States Patent
Yardley et al.

(10) Patent No.: US 10,415,298 B2
(45) Date of Patent: Sep. 17, 2019

(54) LOCK BOX ASSEMBLY

(71) Applicant: Keymaster Solutions, LLC, Wilmette, IL (US)

(72) Inventors: James Yardley, Wilmette, IL (US); Cameron Adams, Winnetka, IL (US)

(73) Assignee: KEYMASTER SOLUTIONS, LLC, Wilmette, IL (US)

( * ) Notice: Subject to any disclaimer, the term of this patent is extended or adjusted under 35 U.S.C. 154(b) by 98 days.

(21) Appl. No.: 15/434,597

(22) Filed: Feb. 16, 2017

(65) Prior Publication Data

US 2017/0234057 A1 Aug. 17, 2017

Related U.S. Application Data

(60) Provisional application No. 62/295,882, filed on Feb. 16, 2016.

(51) Int. Cl.

| | |
|---|---|
| ***E05G 1/08*** | (2006.01) |
| ***E05B 19/00*** | (2006.01) |
| ***E05B 65/00*** | (2006.01) |
| ***E05G 1/024*** | (2006.01) |
| ***E05G 1/04*** | (2006.01) |

(52) U.S. Cl.

CPC ..... *E05G 1/08* (2013.01); *E05B 19/0005* (2013.01); *E05B 65/0075* (2013.01); *E05G 1/024* (2013.01); *E05G 1/04* (2013.01)

(58) Field of Classification Search

CPC ..... A47G 29/1201; A47G 2029/1257; E05G 1/08; E05G 1/04; E05G 1/024; E05G 1/06; E05G 2700/00; E05G 2700/02; E05B 19/0005; E05B 65/0075

USPC ..... 109/45–49, 53–57, 64, 66, 73; 232/24, 232/25, 44; 312/270.2

See application file for complete search history.

(56) References Cited

U.S. PATENT DOCUMENTS

| | | | | | |
|---|---|---|---|---|---|
| 362,544 | A | * | 5/1887 | Scott et al. | |
| 702,479 | A | * | 6/1902 | Reasoner | |
| 762,888 | A | * | 6/1904 | Decker | |
| 929,369 | A | * | 7/1909 | Annable | |
| 1,024,617 | A | * | 4/1912 | Chambers | A47G 29/1201 232/23 |
| 1,239,323 | A | * | 9/1917 | Virovatz | A47G 29/1201 232/1 A |
| 1,318,306 | A | * | 10/1919 | Walker | A47F 3/06 312/120 |

(Continued)

FOREIGN PATENT DOCUMENTS

| | | | |
|---|---|---|---|
| EP | 0205691 | A1 | 12/1986 |
| WO | WO2014124529 | A1 | 8/2014 |

OTHER PUBLICATIONS

Ten Compartment Surface Wall Mount Hand Gun Lockers with Combination Locks, Web page, Store More Store, 2 pgs.

*Primary Examiner* — Lloyd A Gall
(74) *Attorney, Agent, or Firm* — Vedder Price P.C.

(57) ABSTRACT

A lock box assembly includes a shell with one or more partitions defining one or more openings. Compartments are connected to the shell in the one or more openings. The compartments are capable of being rotated about an axis of rotation from a closed to open position in order to receive keys or other items to be deposited and later retrieved. A single axle is inserted through holes in each compartment and through holes in each partition and side panels of the shell to secure the compartments in the lock box assembly.

21 Claims, 20 Drawing Sheets

(56) References Cited

U.S. PATENT DOCUMENTS 1,403,482 A * 1/1922 Breitman ..... A47B 81/067 312/9.42
1,607,121 A * 11/1926 Doran ..... A47G 29/1201 232/24
1,644,215 A * 10/1927 Wilhelm ..... A47G 29/1201 232/24
1,683,218 A * 9/1928 Ward, Jr. ..... A47G 29/1201 232/25
1,725,423 A * 8/1929 Schimmel ..... A47B 65/00 312/328
1,770,188 A * 7/1930 Auth ..... A47G 29/1201 232/24
1,785,404 A * 12/1930 Blackman ..... A47G 29/1201 232/21
2,523,762 A * 9/1950 Howard ..... A01K 5/01 119/464
2,731,319 A * 1/1956 Jacobs ..... A47B 77/16 312/249.7
3,109,586 A * 11/1963 Kohn ..... A47G 29/06 232/43.1
3,193,339 A * 7/1965 Cooper ..... A47F 5/0037 211/81
3,942,851 A * 3/1976 Kaplan ..... A47F 5/0037 248/133
4,396,985 A 8/1983 Ohara
4,648,550 A * 3/1987 Cleary, Jr. ..... A47G 29/1201 109/56
4,651,544 A * 3/1987 Hungerford ..... E05B 19/0005 109/48
4,812,985 A 3/1989 Hambrick et al.
4,893,705 A 1/1990 Brown
5,028,766 A 7/1991 Shah
5,103,659 A * 4/1992 Benefield, Sr. .... A47G 29/1201 232/25
5,143,284 A * 9/1992 Socarras ..... A47G 29/1209 232/17
5,267,688 A * 12/1993 Benefield ..... A47G 29/1201 232/17
5,299,862 A * 4/1994 Rankine ..... G07F 17/12 109/26
5,954,413 A * 9/1999 Brown ..... A47B 46/005 292/145
6,098,433 A * 8/2000 Maniaci ..... E05B 47/0002 292/144
6,814,256 B2 11/2004 Clark
6,843,720 B2 1/2005 Luciano et al.
7,584,869 B2 9/2009 DeLazzer et al.
8,191,781 B2 6/2012 Heinz et al.
8,249,743 B2 8/2012 Pelletier
8,610,574 B2 12/2013 Kestenbaum
D794,418 S * 8/2017 Yardley ..... D8/343
9,968,190 B2 * 5/2018 Olson ..... A47B 67/02
2002/0059043 A1 5/2002 Maloney
2007/0194096 A1 * 8/2007 Pittman ..... A47G 29/1201 232/45
2007/0235397 A1 * 10/2007 Wannop ..... A47B 77/16 211/81
2009/0066476 A1 3/2009 Raheman
2010/0191615 A1 7/2010 Thomas
2012/0222589 A1 * 9/2012 Miyashita ..... E05G 1/005 109/40
2014/0352371 A1 * 12/2014 Lai ..... E05B 37/025 70/27

* cited by examiner

LOCK BOX ASSEMBLY

RELATED APPLICATIONS

This application claims the benefit of and priority from U.S. Application Ser. No. 62/295,882, filed Feb. 16, 2016, which is hereby fully incorporated herein by reference.

BACKGROUND

In the service industry, there is an increased pressure on businesses to operate during non-traditional work hours in order to accommodate the busy schedules of its customers. One example industry where such pressure exists is in the vehicle repair and maintenance industry. It is often difficult for customers to drop-off or pick-up their vehicles before or after repairs or maintenance because customers' often do not have free time during typical business hours due to work schedules or other commitments. In order to accommodate customers' busy schedules, vehicle repair and maintenance facilities may require earlier opening times or later closing times. The extended hours for a vehicle repair or maintenance facility increases the operating overhead for such businesses because employees must be paid during these extended hours. Therefore, there exists a need in the marketplace for a product or process to permit customers to drop-off or pick-up items from a service facility without the need to interact with a physical employee of the service facility.

SUMMARY

In one embodiment of the present disclosure, a lock box assembly includes a housing that receives one or more compartments configured to hold keys or other items. The housing includes a front panel, a rear panel and a top cover. The rear panel includes a mount for securely connecting the one or more compartments to the housing.

In another embodiment of the present disclosure, a lock box assembly includes a shell with one or more partitions defining one or more openings. Compartments are connected to the shell in the one or more openings. The compartments are capable of being rotated about an axis of rotation from a closed to open position in order to receive keys or other items to be deposited and later retrieved.

In another aspect of the present disclosure, the compartments are secured to the shell of the lock box assembly by a single axle that is inserted through holes in each compartment and through holes in partition and side panels of the shell.

In another aspect of the present disclosure, each compartment of the lock box assembly includes a restrictor. The restrictor limits rotation of each compartment when the restrictor contacts a ledge in the shell of the lock box assembly.

BRIEF DESCRIPTION OF THE SEVERAL VIEWS OF THE DRAWINGS

Certain embodiments are shown in the drawings. However, it is understood that the present disclosure is not limited to the arrangements and instrumentality shown in the attached drawings, wherein.

DETAILED DESCRIPTION

Figure 1:
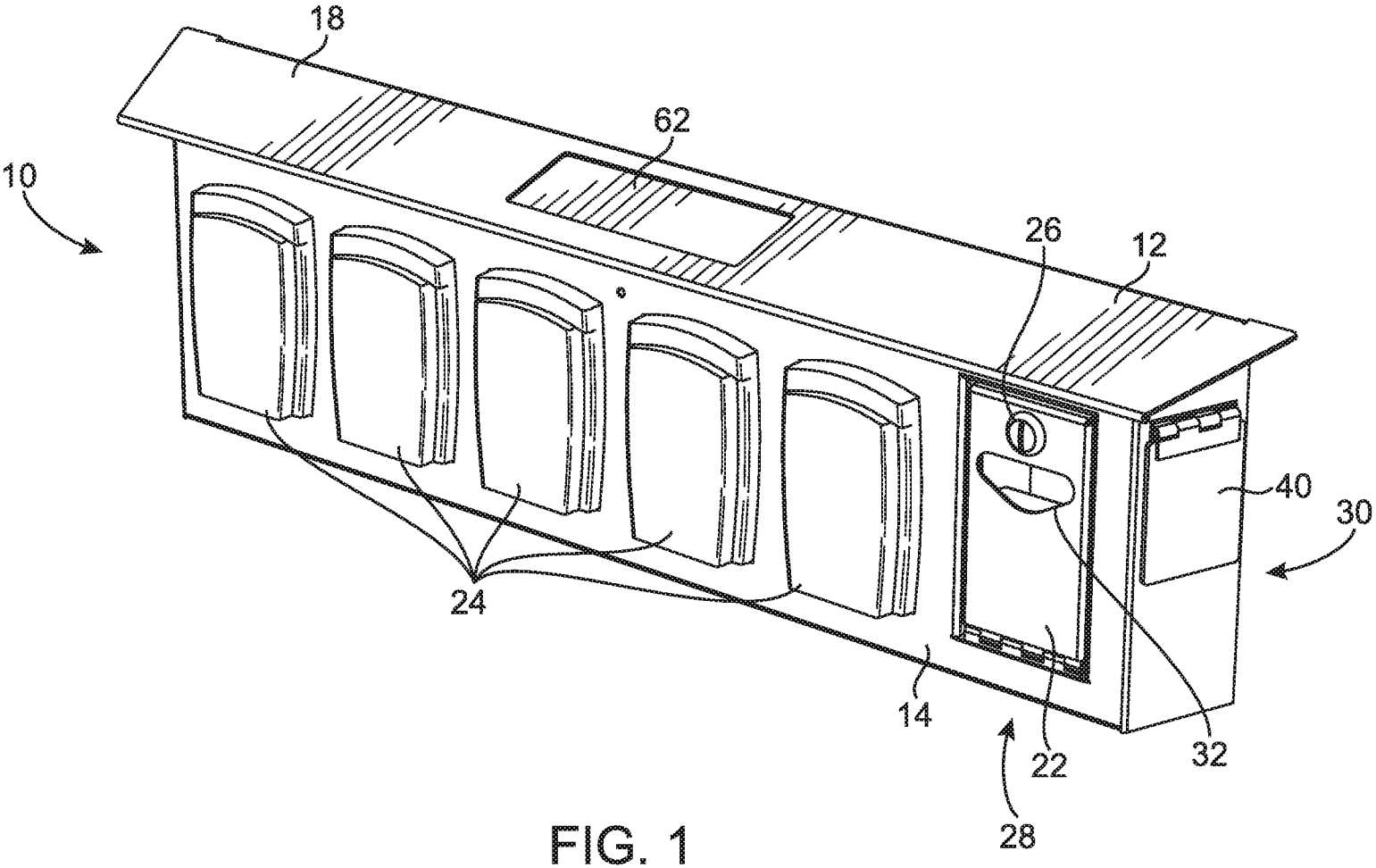
FIG. 1 is an illustration of one embodiment of the lock box assembly of the present disclosure.
Figure 2:
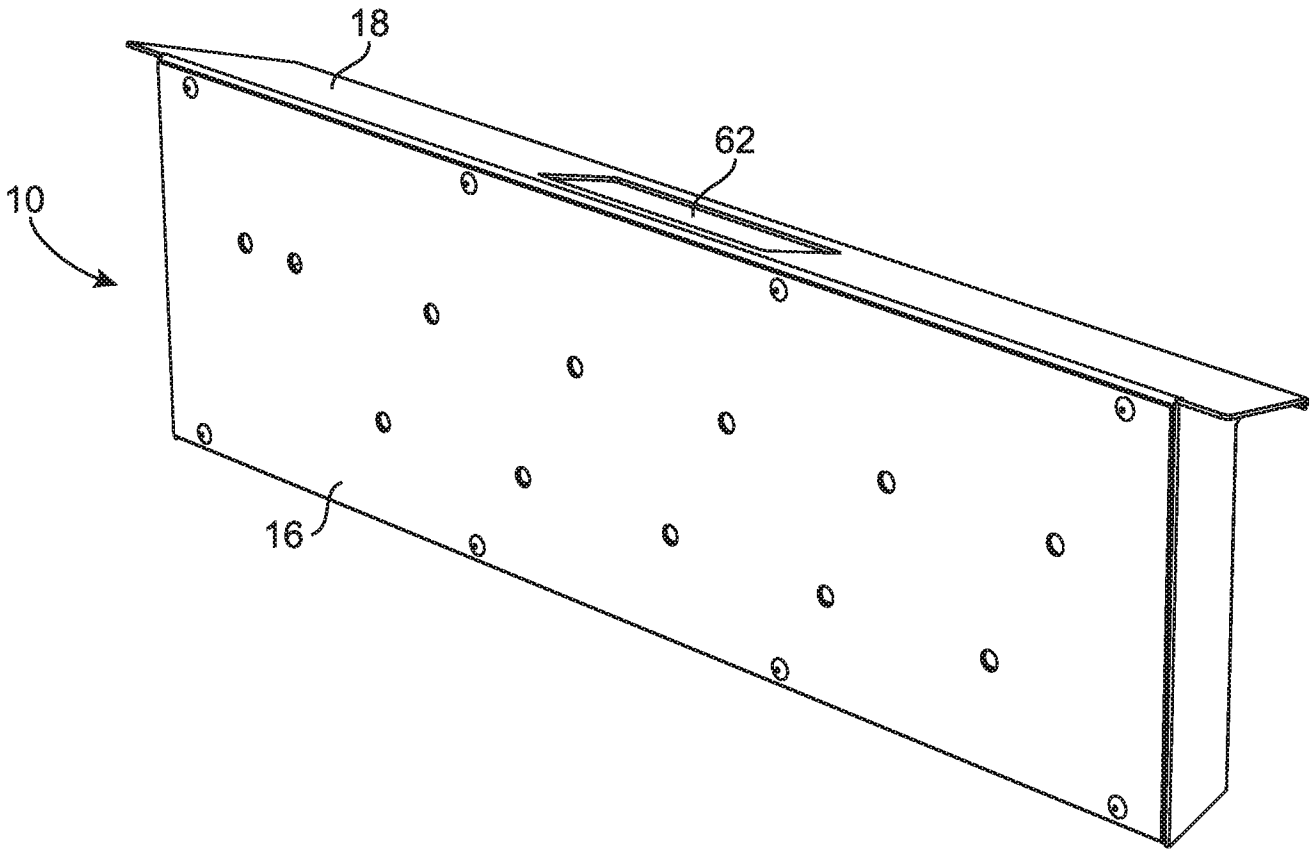
FIG. 2 is an illustration of the back of the embodiment shown in FIG. 1.

For the purposes of promoting and understanding the principles disclosed herein, references are now made to the preferred embodiments illustrated in the drawings and specific language is used to describe the same. It is nevertheless understood that no limitation of the scope of the invention is thereby intended. Such alterations and further modifications in the illustrated device and such further applications of the principles disclosed as illustrated herein are contemplated as would normally occur to one skilled in the art to which this disclosure relates.

As shown in FIG. 1, one embodiment of lock box assembly 10 may include housing 12 and one or more compartments 24. Lockbox assembly 10 may also include drop-off chamber 28 and receptacle 30. As will be further explained, lock box assembly 10 is configured to be securely mounted on a wall. Lock box assembly 10 is configured to receive items in drop-off chamber 28 and may include receptacle 30 that can hold items of information, tags or the like to assist a customer in using lock box assembly 10. The one or more compartments 24 can be lockable compartments in which items can be securely deposited for later retrieval.

Figure 3:
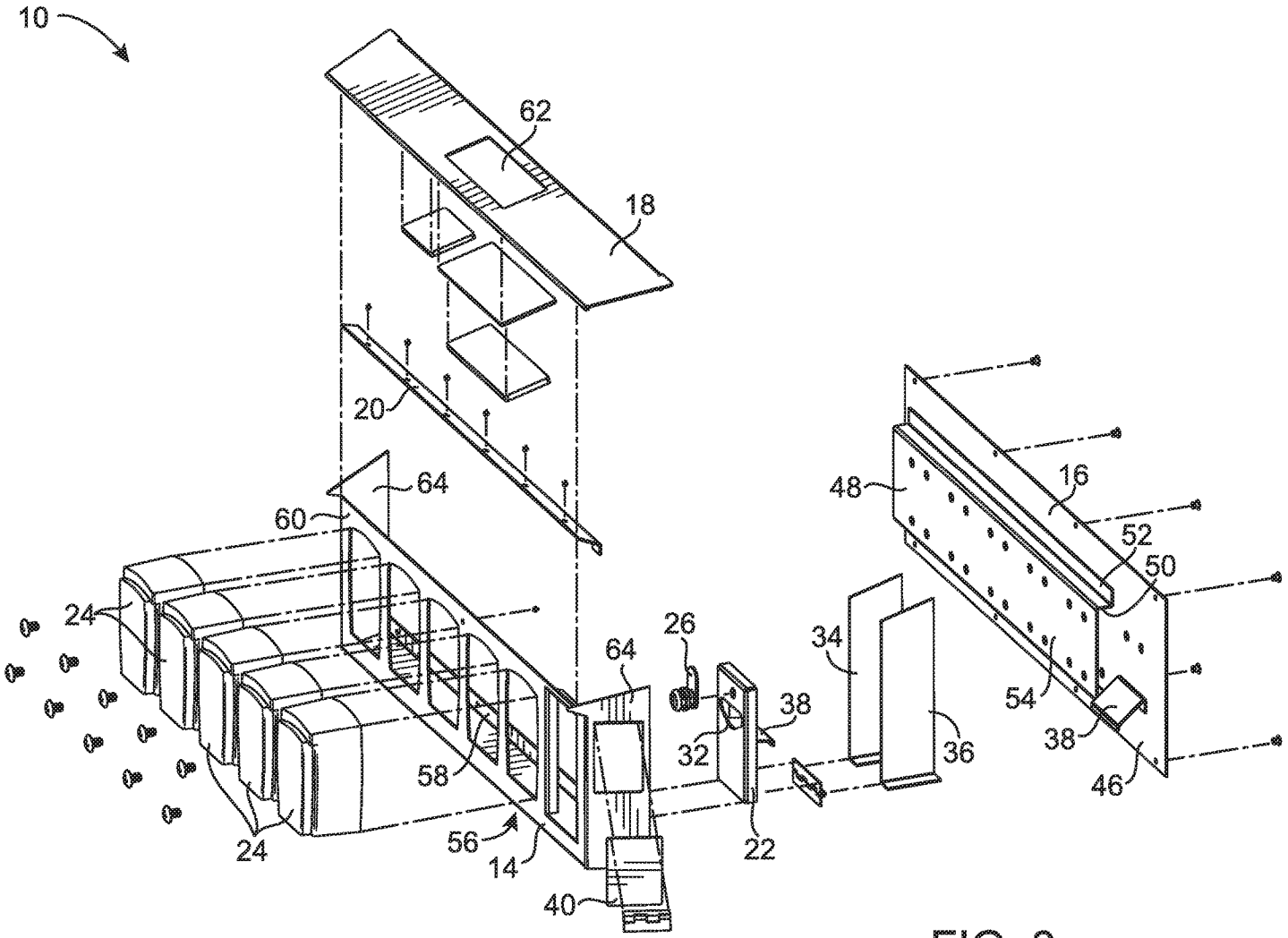
FIG. 3 is an exploded view of one embodiment of the present disclosure.
Figure 4:
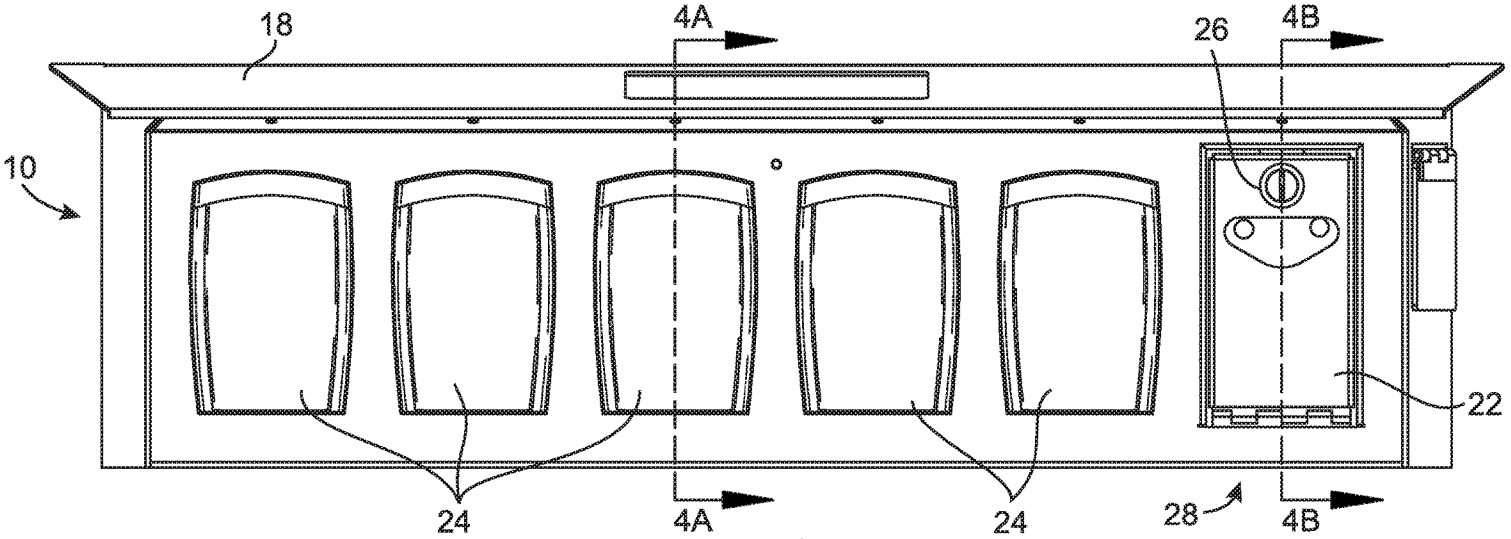
FIG. 4 is a front view of one embodiment of the present disclosure.
Figure 4B:
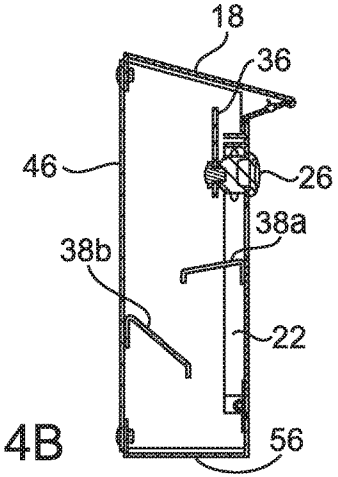
FIG. 4B is a sectional view though a drop-off chamber of one embodiment of the present disclosure.
Figure 4A:
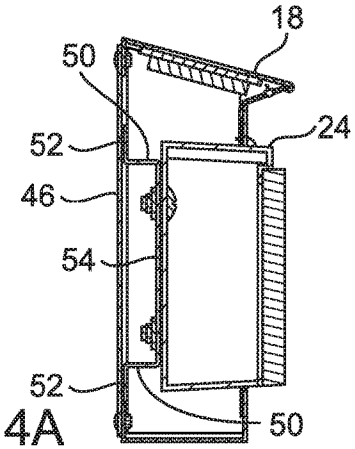
FIG. 4A is a sectional view though a compartment of one embodiment of the present disclosure.
Figure 5:
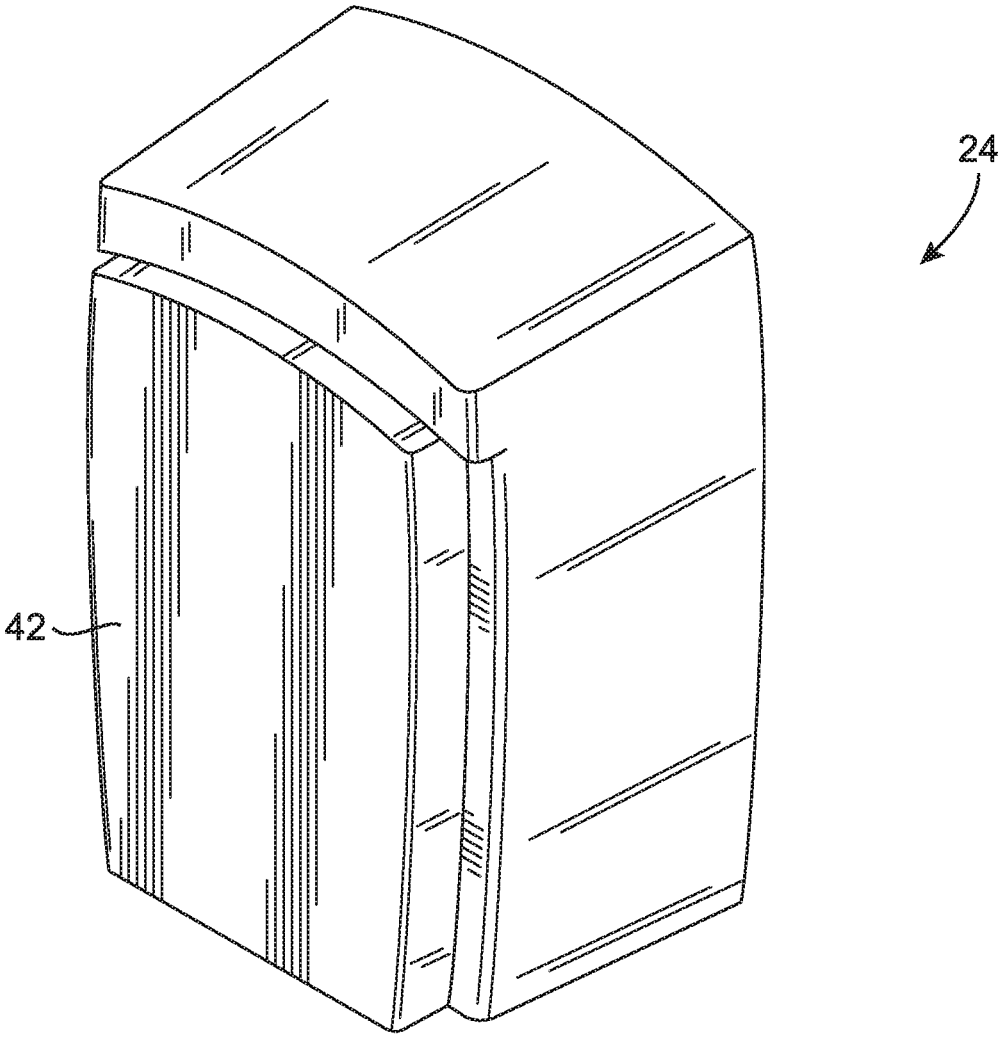
FIG. 5 is an illustration of one embodiment of a compartment of the present disclosure.
Figure 6:
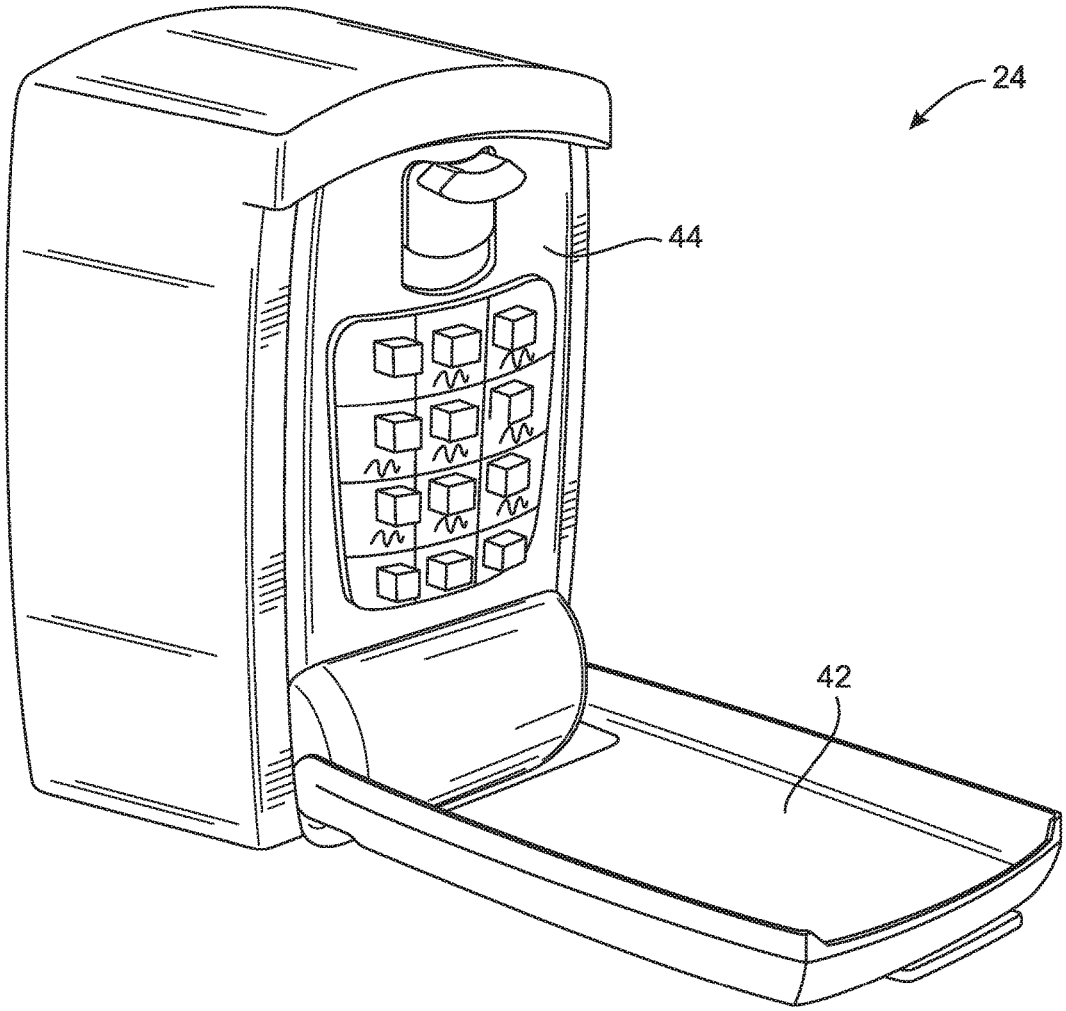
FIG. 6 is an illustration of one embodiment of a compartment of the present disclosure.

In the example shown in FIG. 1, lock box assembly 10 includes drop-off chamber 28. Drop-off chamber 28 may include hinged door 22 with lock 26 and opening 32. In use, a customer requiring repair to his or her vehicle can leave his or her vehicle keys for a repair technician by dropping the keys into drop-off chamber 28 through opening 32. As can be seen in FIG. 3 and FIGS. 5 & 6, drop-off chamber 28 is enclosed by a hinged door 22, first wall 34 and second wall 36, and rear panel 16. Door 22 encloses drop-off chamber on the front portion and includes opening 32 and lock 26. As can be appreciated, lock 26 keeps drop-off chamber securely closed and permits a user of lock box assembly 10 to open and close drop-off chamber 28 such that the contents of drop-off chamber 28 can be easily removed. First wall 34 and second wall 36 are panels of material that enclose drop-off chamber 28 on its lateral sides and partition drop-off chamber from the other portions of lock box assembly 10. In addition, drop-off chamber 28 may include one or more ramps 38. In one example, a first ramp is secured the back of door 22 and a second ramp is secured to rear panel 16. As shown in the example in FIG. 4, first ramp 38*a* and second ramp 38*b* are staggered in the vertical direction in downward sloping configurations. In this configuration, items that are deposited through opening 32 into drop-off chamber 28 slide down first ramp 38*a* and down second ramp 38*b* and fall into the bottom portion of drop-off chamber 28. First ramp 38*a* and second ramp 38*b* obstruct access to the bottom portion of drop-off-chamber 28 from opening 32 so that keys or other items deposited in drop-off chamber 28 cannot be stolen or otherwise removed after being deposited by a customer. Other configurations of drop-off chamber 28, including alternate configurations of ramps 38, can also be used such as spring-loaded doors and movable ramps and other panels so long as the items deposited into drop-off chamber 28 are securely retained until their later retrieval.

Lock box assembly 10 may also include receptacle 30. In the embodiment shown in FIG. 1, receptacle 30 may be located on one end of lock box assembly 10. In this configuration, receptacle 30 is enclosed by front panel 14 on two sides and by rear panel 16 and second wall 36. These panels enclose an area inside lock box assembly 10 in which information, tags or other materials can be positioned for use by a customer. In one embodiment, receptacle 30 includes lid 40. Lid 40 can movably cover a hole in the end portion of front panel 14. As can be appreciated, information or key tags can be placed inside of receptacle 30. Upon arriving at a repair facility, for example, a customer can remove a tag from receptacle 30, write information on the tag and secure the tag to his or keys. The customer could then deposit the keys with the tag into drop-off chamber 28. Receptacle 30 can have other configurations, sizes and shapes such that it can be used for other purposes or to hold other types of materials, such as, business cards, information about the repair facility or the like.

Lock box assembly 10, in one embodiment, may also include one or more compartments 24. Compartments 24, as will be further explained, are the elements of lock box assembly 10 that permit a customer to securely retrieve items from a facility, such as to retrieve vehicle keys from a repair facility. Compartments 24 are individual units each removable from lock box assembly 10. Compartments 24 may include cover 42 and lockable gate 44. Cover 42 is a movable panel that can prevent the lockable gate 44 and the lock portion thereof from exposure to the elements. In one example, cover 42 is made of a plastic material and is hinged at one end to permit cover 42 to be moved from a closed position as shown FIG. 5 to an open position as shown in FIG. 6. In other embodiments, cover 42 can be have other shapes and configurations and can be made of different materials so long as it is capable of shielding the lock portion of gate 44.

As shown in FIG. 6, gate 44 can include a lock portion attached to or integrated into gate 44. In one embodiment, gate 44 includes a plurality of buttons that actuate a combination lock. In this embodiment, gate 44 includes a reconfigurable combination lock. When the combination is actuated via the plurality of buttons on gate 44, the lock is opened and gate 44 can be removed or opened on compartment 24 such that inside portion of compartment 24 is exposed so that items can be deposited into compartment 24 or retrieved from compartment 24.

As shown in one embodiment on FIG. 1 and FIG. 3, one or more compartments 24 may be integrated into lock box assembly 10 via housing 12. Housing 12, as previously described, includes drop-off chamber 28 and receptacle 30 but also may include elements to secure lock box assembly 10 to a wall and to receive and secure compartments 24. Housing 12, in one embodiment, includes top cover 18, front panel 14 and rear panel 16. Top cover 18, front panel 14 and rear panel 16 can be made from sheet metal, plastics, composites or other suitable materials.

As shown in FIG. 3, in one embodiment, rear panel 16 includes plate 46 and mount 48. Plate 46 can include a plurality of attachment locations or holes through which fasteners, such as screws, bolts, rivets or the like can be placed to secure rear panel 16 to a wall. Mount 48 is connected to plate 46 and is the portion of housing 12 to which compartments 24 can be attached. In one embodiment, mount 48 includes a offset surface positioned substantially parallel to and offset from the surface of plate 46. Legs 50 position the offset surface a predetermined distance away from the surface of plate 46. Flanges 52 are connected to legs 50 and are directly connected to plate 46 in this embodiment. Flanges 52 can be connected to plate 46 via any suitable attachment method including, welding, via bolts, screws or other fasteners. Mount 48 can be a rectangular piece of sheet metal formed into the aforementioned configuration and connected to plate 46. In other embodiments, mount 48 is integrally formed with plate 46.

As further shown in FIG. 3, mount 48 may include one or more attachment holes on offset surface 54. Compartments 24 can be bolted, riveted, welded or otherwise connected to offset surface 54 of mount 48. In one embodiment, gate 44 of compartment 24 is removed and a bolt is pushed through a hole in the back of compartment 24 through a corresponding hole in mount 48. The predetermined space between offset surface 54 and plate 46 permits a nut to be secured to the bolt. When the bolt and nut combination is tightened, compartment 24 is secured to rear panel 16 and can also be later removed for easy maintenance or replacement of compartment 24. Other attachment methods can also be used to connect compartment 24 to rear panel 16.

Housing 12 may also include front panel 14. As shown in FIG. 3, front panel 14 includes a front portion 60 that is substantially parallel to rear panel 16 and may also include side portions 64, a bottom portion 56, and a rear tab 58. Front portion 60 may include one or more windows through which the one or more compartments 24 are received. Front portion 60 may also include a window that is covered by door 22 to enclose drop-off chamber 28. Side portions 64 are located at either lateral end of front portion 60 and create the outer ends of lock box assembly 10 when assembled. One of the side portions 64 can include a hole that is covered with lid 40 to enclose receptacle 30. Front panel 14 may also include rear tab 58. In one embodiment rear tab 58 is positioned substantially parallel to front portion 60 and may include one or more attachment holes. Front panel 14 can be connected to rear panel 16 at rear tab 58 via fasteners, welding or other attachment methods.

In one embodiment, front panel 14 is made of single piece of sheet metal formed into the configuration shown in FIG. 3. In other embodiments, multiple pieces of material can be separately cut or formed and then connected together using suitable attachment methods known to one of ordinary skill in the art. In still other embodiments, front panel 14 is molded or otherwise formed from plastic or other composite materials.

Housing 12 of lock box assembly 10 may also include top cover 18. Top cover 18 is positioned on the top of housing 12 and can be oriented in a downward sloping fashion to behave as the roof of housing 12. Top cover 18 may include an attachment tab such that it can be fastened or otherwise attached to front panel 14 or to rear panel 16 or both.

Housing 12 may also include bevel 20 located beneath a front edge of top cover 18 and above compartments 24 of lock box assembly 10 when fully assembled. Bevel 20 may include one or more lights, such as one or more LEDs. The one or more lights in bevel 20 can be positioned above the one or more compartments so that a user is able to see the contents and/or the combination locks of compartments 24. A solar panel 62 can be fitted into top cover 18 along with a battery, power supply and other necessary electrical components in order to provide the necessary energy to power the one or more lights in bevel 20. In other embodiments, lock box assembly 10 can be connected to an external power source to energize the electronic components.

Figure 7:
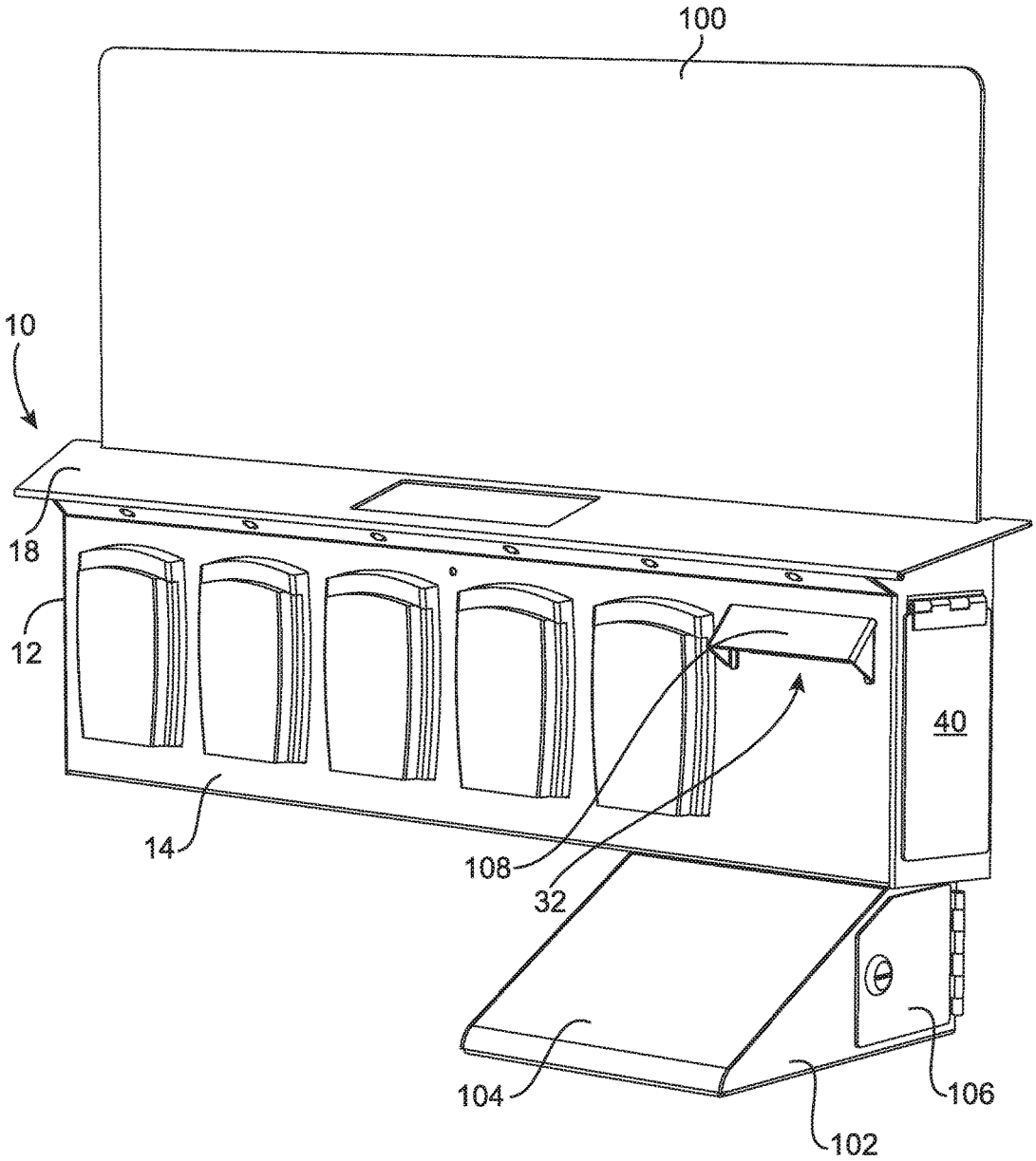
FIG. 7 is an illustration of another embodiment of a lock box assembly of the present disclosure.
Figure 8:
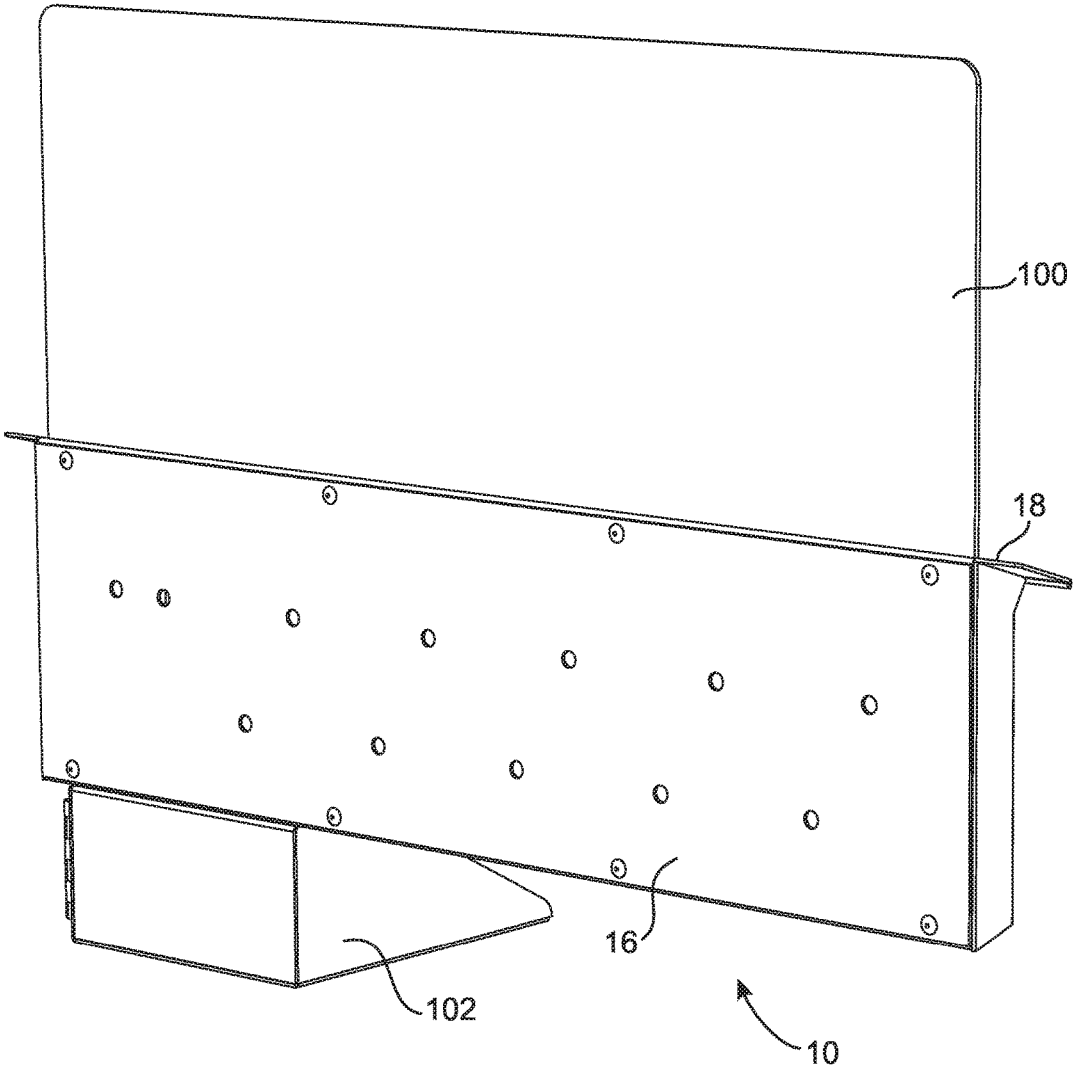
FIG. 8 is an illustration of the back of the embodiment shown in FIG. 7.

FIGS. 7-11 illustrate another embodiment of lock box assembly 10. Many similar elements can be found in other embodiments of lock box assembly 10. For example, as shown in FIG. 7, lock box assembly 10 includes housing 12, top cover 18, front panel 14, opening 32, and lid 40. The construction and assembly of housing 12 may be similar to that previously described. In this alternate embodiment, lock box assembly 10 also includes sign 100, shoe 102 with work surface 104, hatch 106 and hood 108. Other embodiments of lock box assembly 10 may include one or all of these additional elements in various configurations.

As shown in FIG. 7, lock box assembly 10 may include sign 100. Sign 100 is a piece of material onto which letters, designs, logos or other visual information or material can be placed by a user of lock box assembly 10. In one example, sign 100 is a planar piece of steel connected to housing 12 via any suitable means. Sign 100 can be removable so as to service or maintain lock box assembly 10. Sign 100 can be suited or configured with holes or other attachments or fasteners so that a user can fix materials that describe a place of business, to include instructions for use of lock box assembly 10 or for affixing other information. Sign 100 may also be constructed of other plastics, woods, natural or synthetic materials.

Figure 10:
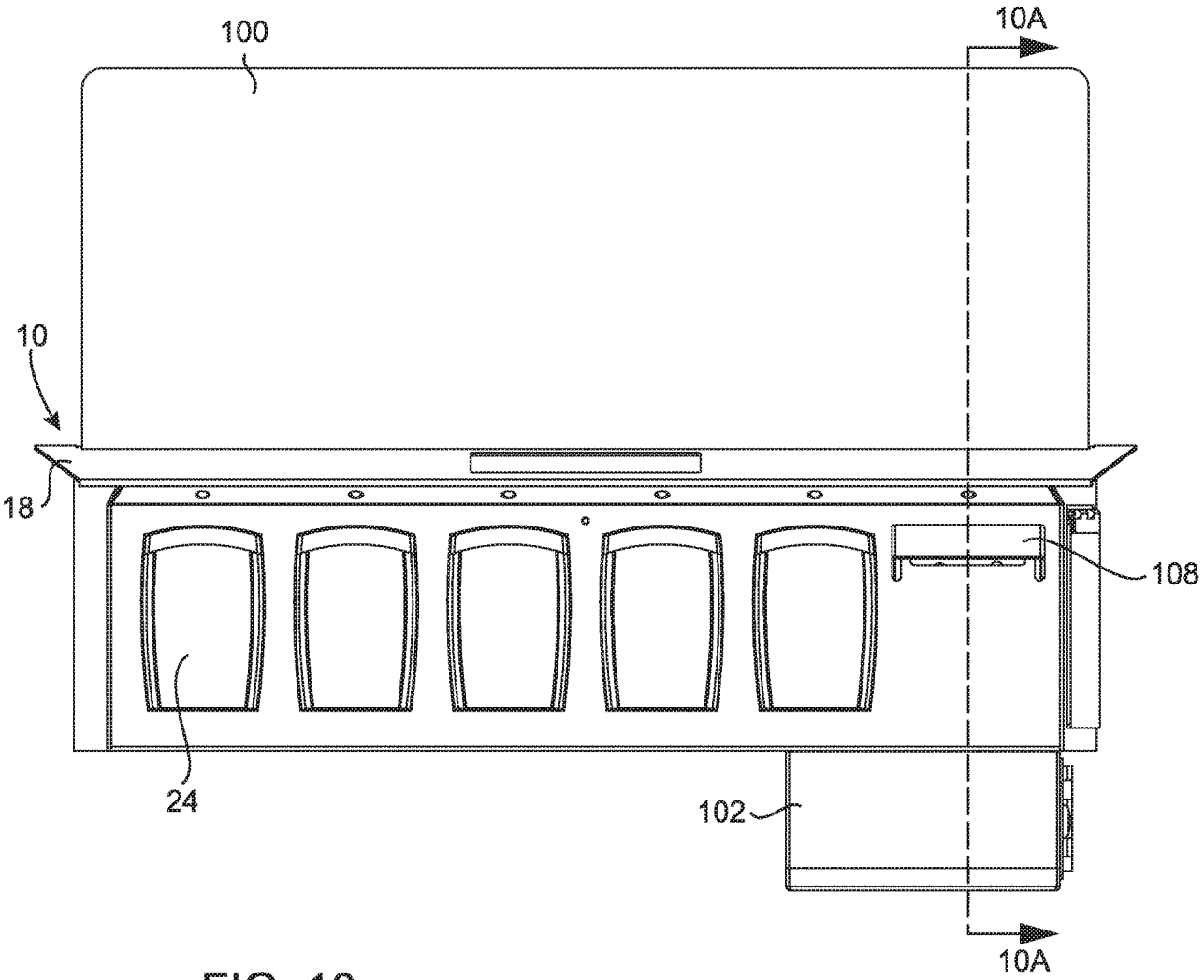
FIG. 10 is a front view of another embodiment of the present disclosure.
Figure 10A:
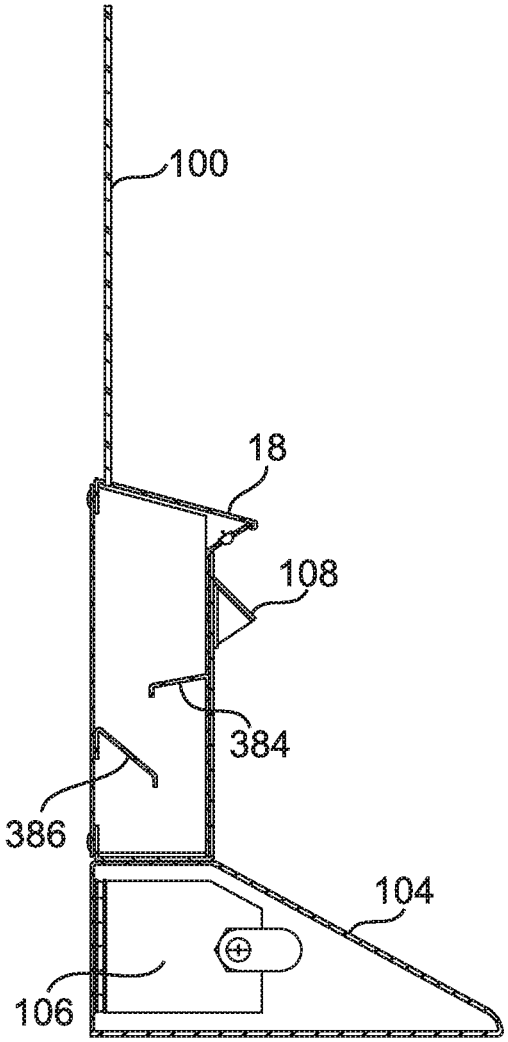
FIG. 10A is a sectional view through a compartment of another embodiment of the present disclosure.
Figure 11:
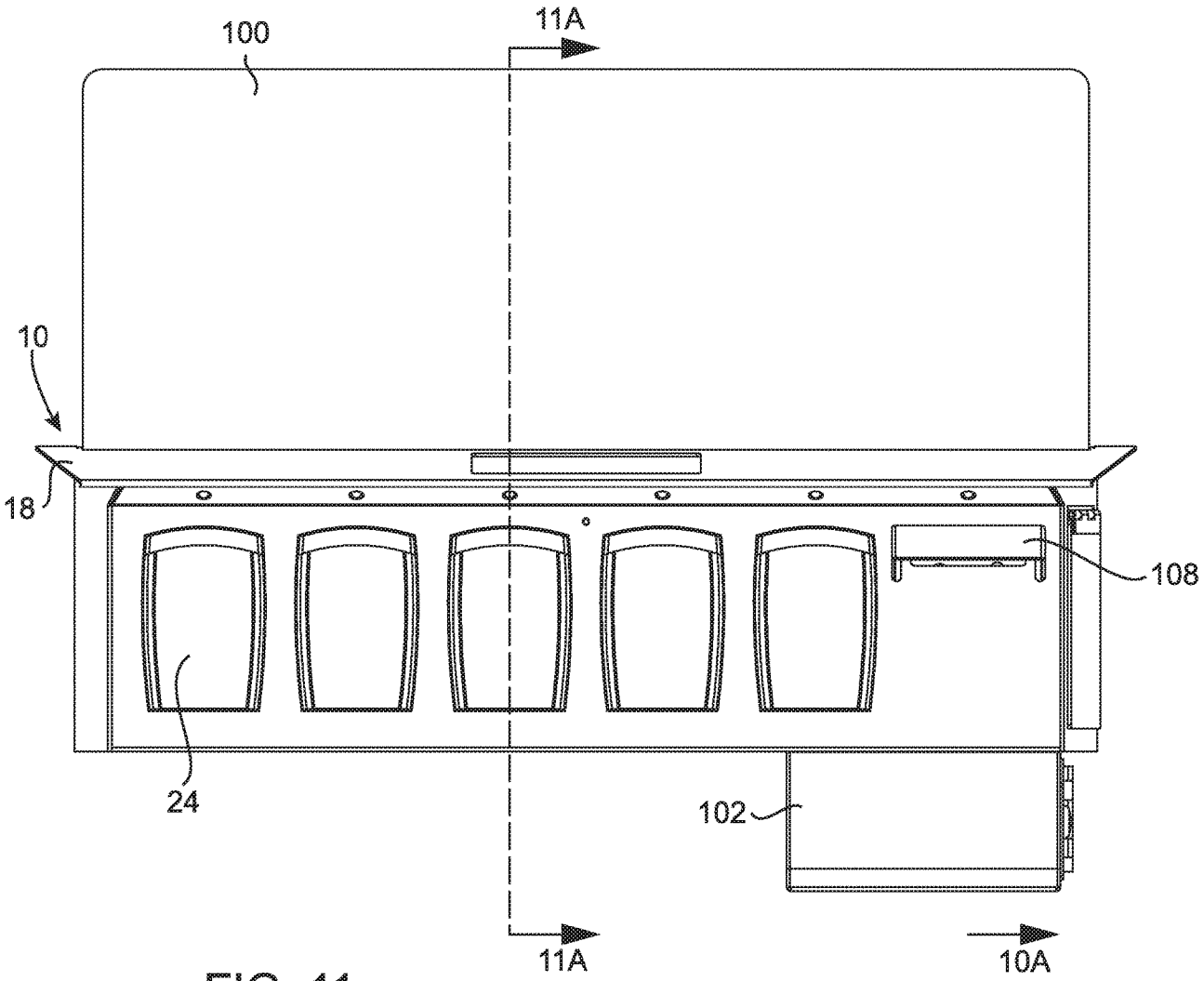
FIG. 11 is a front view of another embodiment of the present disclosure.
Figure 11A:
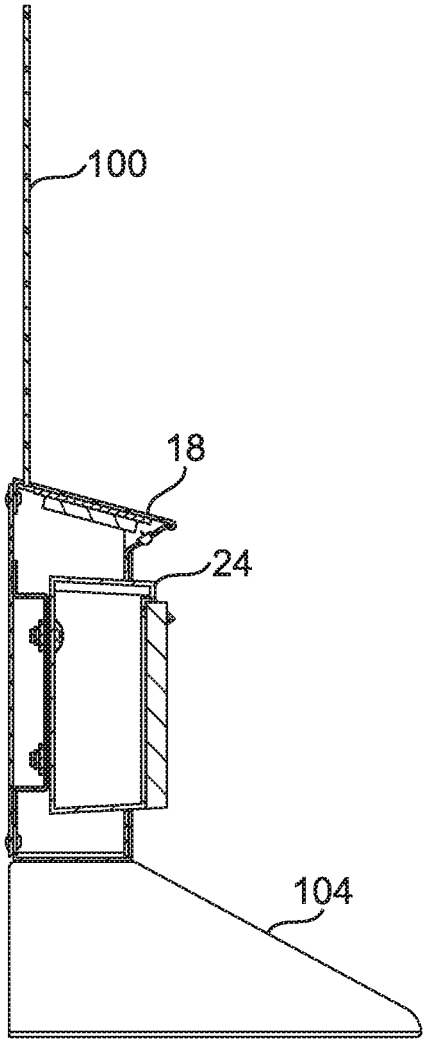
FIG. 11A is a sectional view through a drop-off chamber of another embodiment of the present disclosure.

Lock box assembly 10 may also include shoe 102 that may include work surface 104 and hatch 106. Shoe 102 is an enclosure that extends from housing 12. Shoe 102 can extend below and/or outward from housing 12. In the example shown in FIG. 7 and as shown in FIGS. 10A and 11A, shoe 102 can have work surface 104 that extends outward from housing 12 toward a user of lock box assembly 10. As can be appreciated, work surface 104 is a surface of material that permits a user to write information on order forms, sign invoices or credit card receipts or for any other suitable purpose applicable to the location of lock box assembly 10. As can be appreciated, when lock box assembly 10 is mounted on a wall, for example, work surface 104 is an added feature of lock box assembly 10 that permits simple and easy drop-off of keys or other items.

Figure 9:
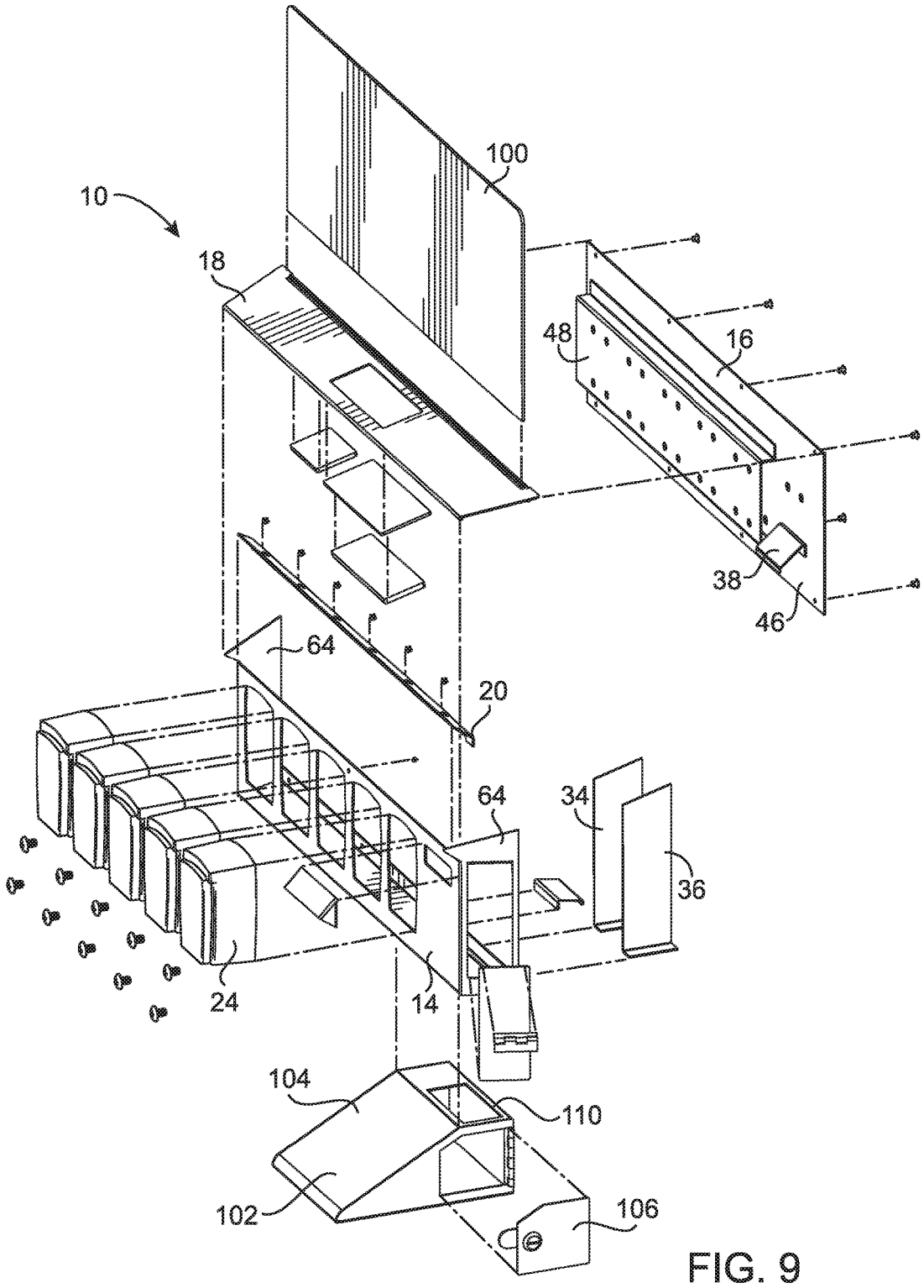
FIG. 9 is an exploded view of another embodiment of the present disclosure.

As can be seen in FIGS. 9 and 11A, shoe 102, in this embodiment, also serves to extend drop-off chamber 28. As shown in FIG. 9, shoe may include through-hole 110 that permits keys or other items that are placed into drop-off chamber 28 to fall down through housing 12 and into shoe 102. This added space provided by shoe 102 permits more keys or other items to deposited into lock box assembly 10. Shoe 102 can also include hatch 106. In one embodiment hatch 106 is piece of steel or other suitable material connected to shoe 102 via a hinge such that a user can unlock hatch 106 and retrieve the keys or other items that have been deposited into drop-off chamber 28 that have fallen into shoe 102. Hatch 106 can be have various sizes and shapes so long as it permits a user to retrieve the items that are intended to be dropped off in lock box assembly 10.

As shown in FIG. 7, lock box assembly 10 may also include hood 108. Hood 108 can be a shaped piece or steel or other suitable material and can also be formed from a plastic or from other suitable synthetic or natural materials. Hood 108 is situated on housing 12 in the area of opening 32. As previously described, drop-off chamber 28 may include opening 32 through which a user can leave keys or other items in lock box assembly 10. Hood 108 in one embodiment is positioned on front panel 14 just above opening 32. Hood 108 can be shaped to surround or partially surround opening 32. In this manner, hood 108 prevents rain, snow or other environmental elements from entering drop-off chamber 28. Hood 108 can also make it more difficult for a person to attempt to extract items that have been deposited into drop-off chamber 28.

When fully assembled, lock box assembly 10 provides a simple and secure mechanism for the deposit and retrieval of items for use in a variety of circumstances. In the context of a vehicle repair facility, lock box assembly 10 provides a mechanism for the drop-off and retrieval of vehicle keys. The secure and simple design permits a customer to drop off or retrieve his or her keys at times of the day outside of normal business hours without interacting with an employee of the repair facility. For example, a customer seeking vehicle repair services can open lid 40 and obtain a key tag. The key tag, denoting a vehicle license plate number, for example, can be placed on the customer's key ring with the vehicle keys and deposited in the opening in drop-off chamber 28. The work surface 104, in one embodiment, can be used to write down a vehicle license plate number on a key tag before it is deposited into the lock box assembly. A repair technician can then retrieve the deposited vehicle keys from drop-off chamber 28 by opening door 22 in one embodiment or by opening hatch 106 in another embodiment. After the customer's vehicle is repaired, the repair technician can place the customer's keys in one of compartments 24 and lock the compartment. The repair technician can then contact the customer and inform the customer that the vehicle is ready to picked up and provide the customer with the combination of the appropriate compartment. The customer can then use the combination to open the compartment and retrieve the customer's vehicle keys at a time when it is convenient for the customer.

Figure 12:
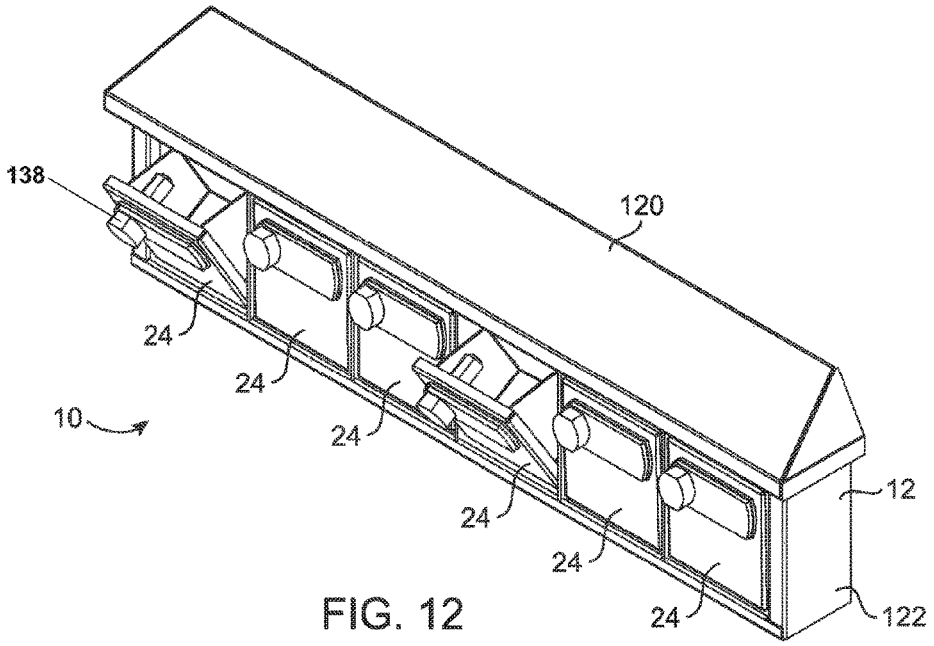
FIG. 12 is an illustration of another embodiment of a lock box assembly of the present disclosure.
Figure 13:
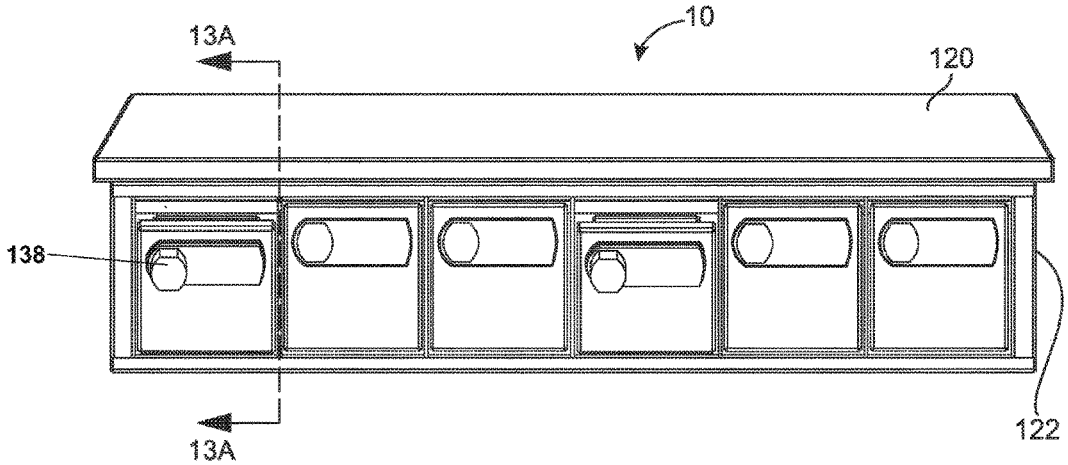
FIG. 13 is a front view of the embodiment of FIG. 12.
Figure 14:
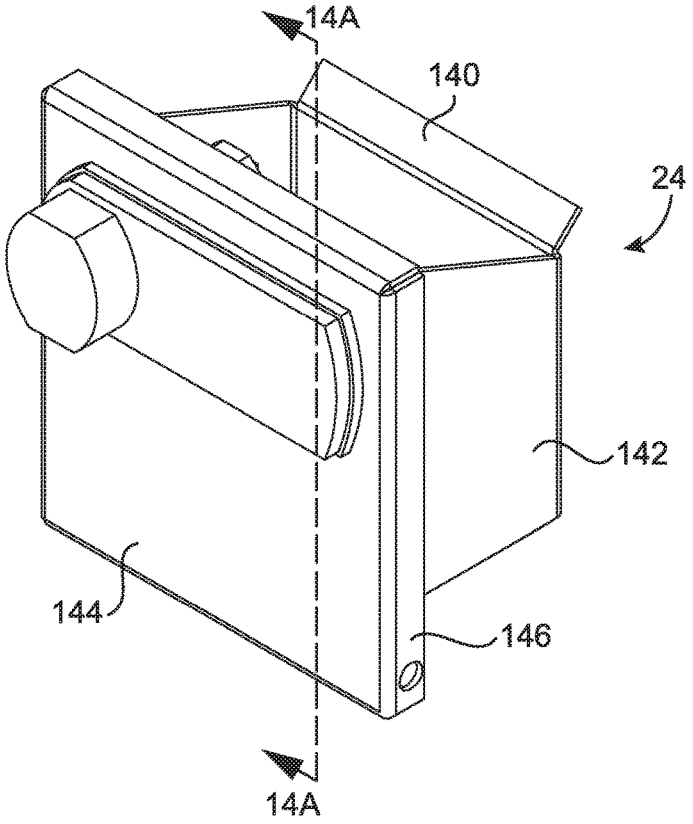
FIG. 14 is an illustration of another embodiment of a compartment of the present disclosure.
Figure 15:
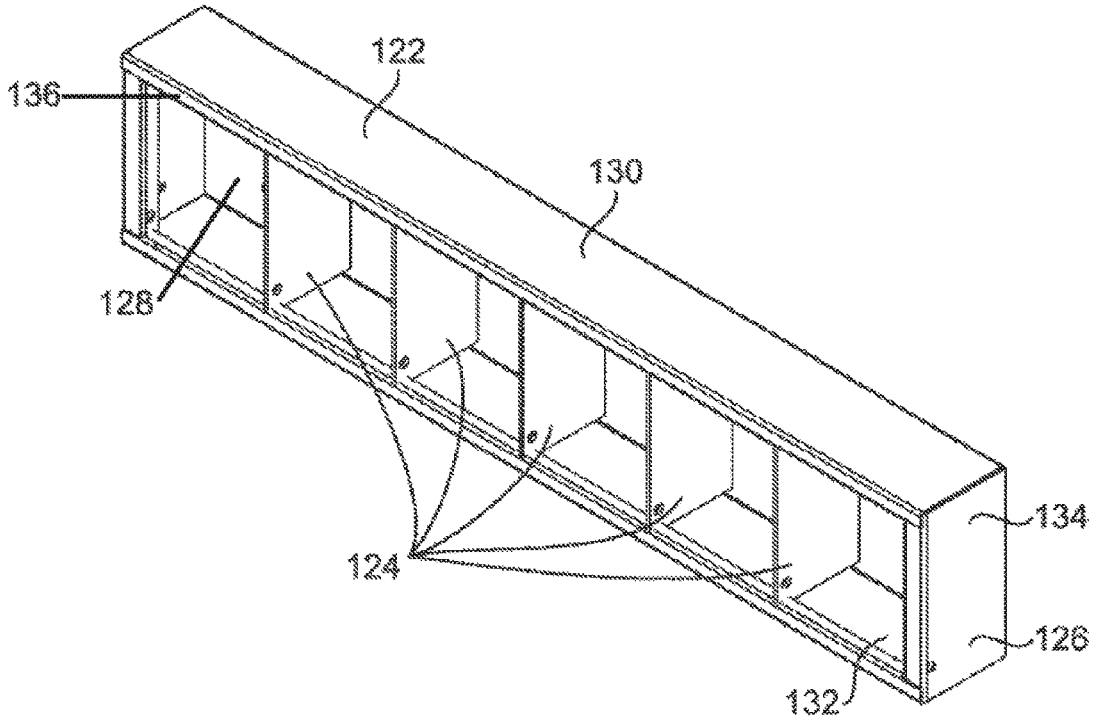
FIG. 15 is an illustration of a shell of a lock box assembly of the present disclosure.

FIGS. 12-14 show yet another embodiment of lock box assembly 10. In this embodiment, lock box assembly 10 may include shell 122, roof 120 and one or more compartments 24. Shell 122, in this example, is the component of lock box assembly 10 into which compartments 24 are inserted and secured. Shell 122 can be a rectangular-shaped box that includes back panel 128, upper panel 130, lower panel 132 and two side panels 134. Shell 122 may also include one or more partitions 124 spaced and secured to back panel 128 and/or upper panel 130 and/or lower panel 132. As shown in FIG. 15, the resulting assembly is a box with several rectangular or square shaped openings into which compartments 24 can be fixed. Shell 122 and partitions 124 can be made of any suitable material such as metal, plastic, composite or combinations thereof. In one example, shell 122 is made of 16 gauge galvanized steel sheet. The shape of shell 122 can be created, in one method of manufacture, by bending a pre-cut sheet into the shape shown in FIG. 15 such that back panel 128, upper panel 130, lower panel 132, and both side panels 134 are formed from one piece of steel. Partitions 124 can be cut of steel sheet as well and then fixed via welding, fasteners, staking or the like to create the formed steel box as previously described. Other methods of manufacture can also be used such as cutting or forming one or more of back panel 128, upper panel 130, lower panel 132 or side panels 134 from separate pieces of material and joining or connecting the separate pieces together to form shell 122.

Figure 15A:
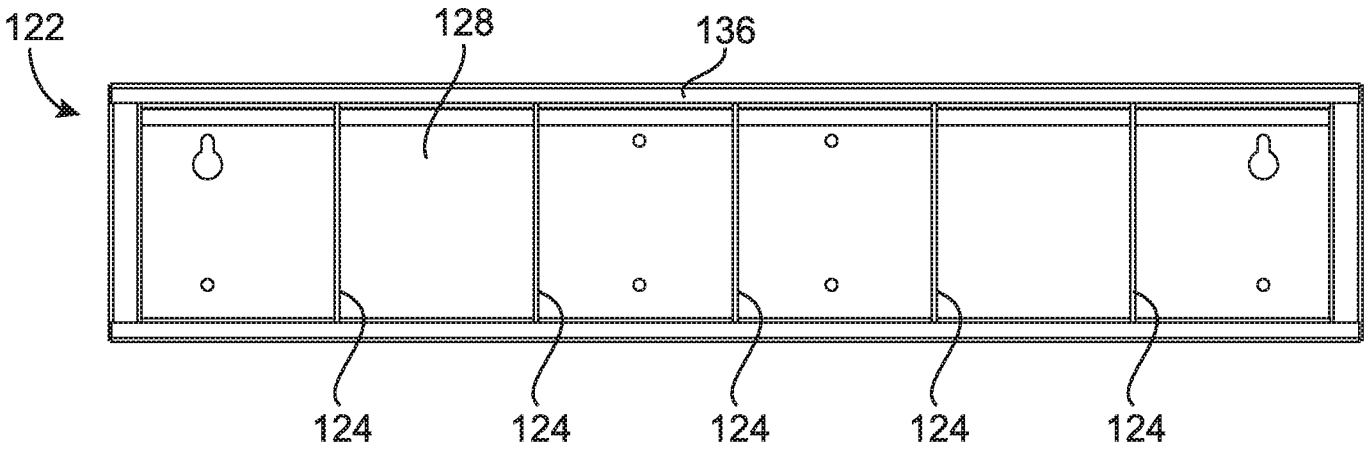
FIG. 15A is a front view of the shell depicted in FIG. 15.

As further shown in FIG. 15, shell 122 may include ledge 136. In this example, ledge 136 is a formation on the front of shell 122 that is located below upper panel 130 and is located across the top of each of the openings into which compartments 24 are fixed. Ledge 136 can be formed from the same piece of material as upper panel 130 or can be created separately and attached or joined to shell 122 using methods know to one of ordinary skill in the art. Shell 122 may also include axle holes 126. Axle holes are positioned in side panels 134 and in each of partitions 124. In this manner a single axle can be used to extend through shell 122 and through each of compartments 24 to provide a single axis of rotation for the compartments as will be described. Shell 122 may also include one or more mounting holes located on and through back panel 128. The mounting holes are located on back panel 128 such that lock box assembly 10 can be mounted to the wall or other support surface at an installed location. Since the holes are located on back panel 128, the fasteners that are used to secure lock box assembly 10 to a wall, for example, are concealed and secure from tampering once the compartments are installed in the openings after mounting. As shown in FIG. 15A, one embodiment of shell 122 includes eight mounting holes with two of the holes being enlarged so that shell 122 can be hung while the remaining fasteners are secured through the other mounting holes. Other patterns and quantities of mounting holes can also be used to mount lock box assembly 10.

Figure 13A:
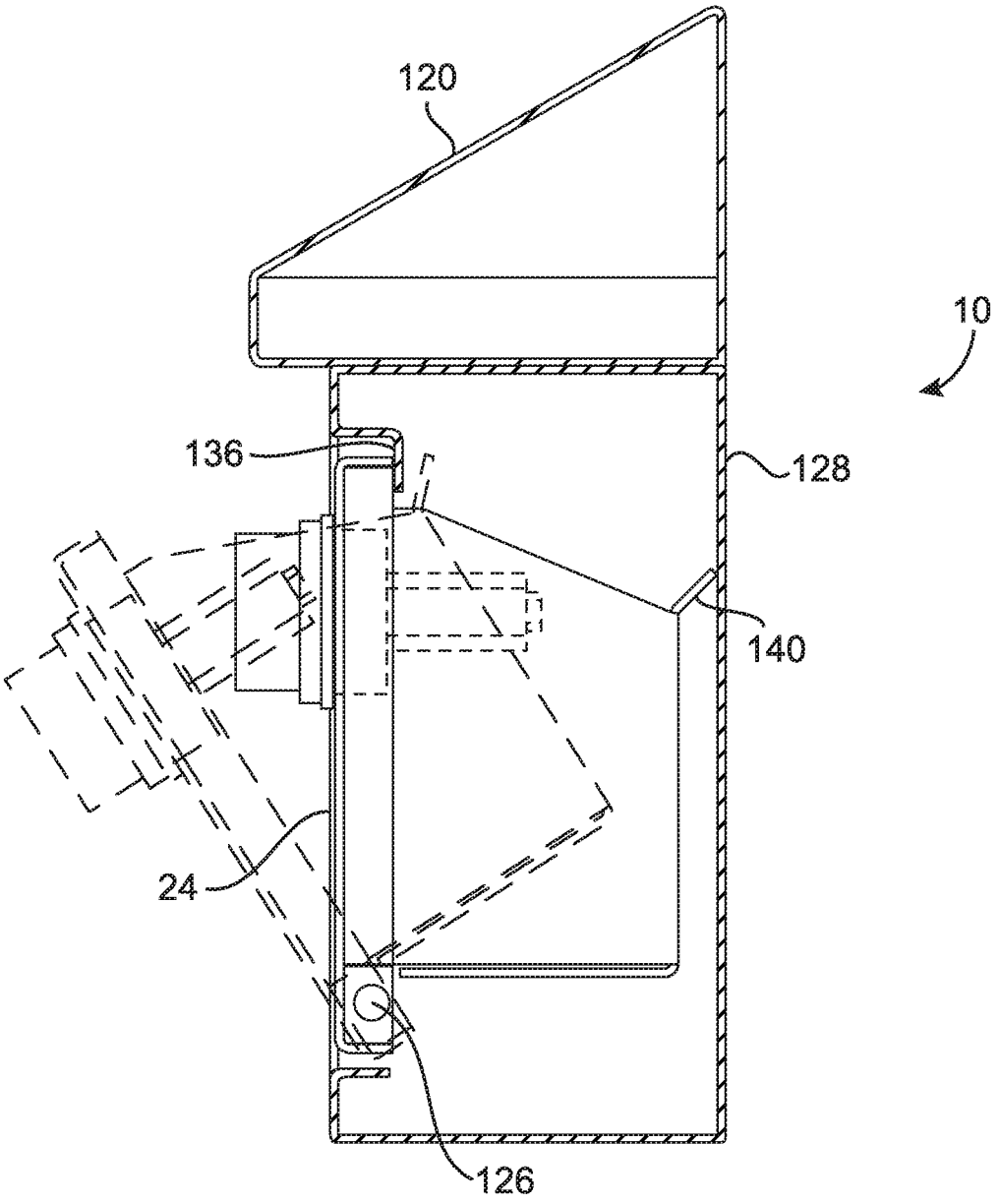
FIG. 13A is a sectional view through a compartment of the embodiment of FIG. 12.

As shown in FIGS. 12 and 13, lock box assembly may also include roof 120. Roof 120 is connected to the top of shell 122. In one embodiment, roof 120 is made of the same material as shell 122, such as 16 gauge galvanized sheet metal and is formed by bending a blank of sheet metal into the triangular shape shown in FIG. 12. Roof 120 can then be fixed to shell 122 by fasteners, welding, adhesive or other suitable joining technique. In other examples, roof 120 is made of other materials such as metals, alloys, plastics, composites or the like. Roof 120, as shown in FIG. 13A, may have a depth that is larger than the depth of shell 122 such that roof 120 overhangs shell 122 along the front-facing surface of shell 122 near ledge 136. In this manner, roof 120 with its angled surface deflects rain, snow and other elements away from shell 122 and compartments 24 located therein. In a similar manner, roof 120 can be wider than the width of shell 122 such that it deflects environmental elements away from side panels 134 of shell 122. Other shapes and configurations of roof 120 can also be used to achieve similar results yet having different appearances.

In the example shown in FIG. 12, compartments 24 are received into shell 122. FIG. 14 shows one example compartment that can be used with the shell as previously described. Compartment 24, in one example, includes lock assembly 138, restrictor 140, bin 142 and face 144. Compartment 24 is configured to receive a user's keys or other items that are deposited for safe-keeping and for subsequent retrieval. Bin 142 is the portion of compartment 24 that creates the volume defined by the walls and bottom of bin 142. Bin 142 is sized appropriately so as to include sufficient room for a user to deposit the items necessary for the business at which lock box assembly 10 may be used. For example, at an automotive repair business, bin 142 is sized such that automotive keys and key fobs can be easily deposited and retrieved by a user. In one example, bin 142 is created by bending a blank of sheet metal into the formation shown in FIGS. 14 and 14A. Bin 142 in other examples can have other shapes and be made of different materials such as other metals, alloys, plastics or composites. Bin 142 may also be created using other methods of manufacture such as injection forming, stamping or other methods known to one of ordinary skill in the art.

Figure 14A:
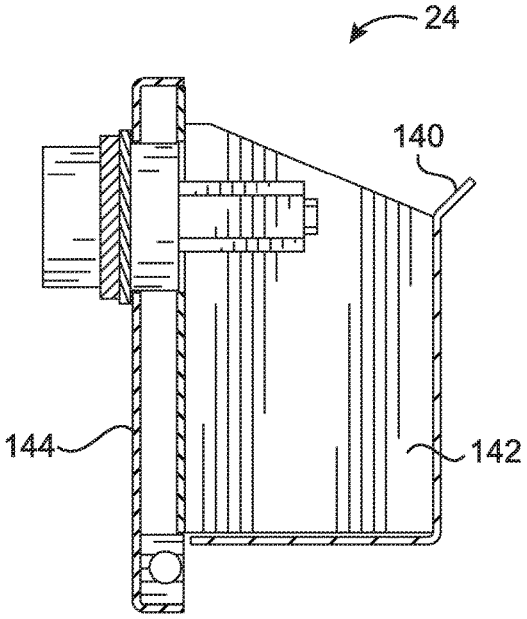
FIG. 14A is a section view through the compartment depicted in FIG. 14.

Compartment 24, in one embodiment, includes face 144. Face 144 is a cover or outward facing component of compartment 24. As can be seen in FIG. 13, face 144 is the exposed part of compartment 24 when compartment 24 is in the closed position. Face 144, in one embodiment, is formed of galvanized sheet metal that is shaped to have a front surface and side edges 146. In other embodiments, face 144 is made of other materials and is formed using other suitable techniques known to one of ordinary skill in the art. Face 144 is connected to bin 142. Face 144 can be joined to bin 142 via fasteners, welding, adhesive or other suitable joining method. Face 144 may also include openings at the lower portion of side edges 146 as shown in FIGS. 14 and 14A. The openings in the lower portion of side edges 146 are configured so as to align with axle holes 126 that are located in shell 122. As can be appreciated, when compartments 24 are inserted into shell 122 and the openings in the lower portion of side edges 146 are aligned with axle holes 126, an axle can be inserted through axle holes 126 and the openings in the lower portion of side edges 146. An axle installed into shell 122 and through compartments 24 not only secures the compartments into shell 122 but also creates an axis of rotation for compartments 24. In this configuration and as shown in FIG. 13A, compartment 24 is able to rotate about axle hole 126 such that compartment can be moved from a closed position (as shown in solid lines) to an open position (as shown in dashed lines). As shown, lock box assembly 10 has a single axle that extends through shell 122 and each compartment 24. In other examples, each compartment can be fit with individual axles or pins such that the same or similar functionality is accomplished.

The single axle embodiment described above provides several advantages. Since only the single axle needs to be removed from the lock box assembly in order to permit the removal of all compartments, lock box assembly 10 can be easily cleaned or repaired in this embodiment. It is possible that a user could forget his or her combination to the lock assembly or the lock assembly could malfunction. In these failure modes, repair is quick and efficient if a single axle is used. In these types of failure situations, the single axle is removed and the malfunctioning compartment can be replaced or repaired.

The single axle may have different configurations in order to provide the foregoing described advantages. In one embodiment, the single axle is rod made of steel or other suitable material with an overall length longer than the length of shell 122. This length of the single axle permits it to extend through each compartment and shell 122 with a portion of the single axle extending beyond each side panel 134 of shell 122. One end of the single axle may have a shaped end with an outside width or diameter that is larger than the hole in side panel 134. In this example single axle, the shaped end abuts one side panel 134 of shell 122 and the axle extends through the shell, through the axle holes 126 in partitions 124, through each compartment 24 and the other end of the single axle extends out of the other side panel 134. On this other end of the single axle a lock, such as a cylinder lock, pad lock or other suitable lock, is fixed. In this manned, the single axle is securely connected to lock box assembly 10. To remove, the lock is simply disengaged from the single axle and the single axle is pulled out of lock box assembly 10 releasing the one or more compartments 24. Other embodiments or configurations of the single axle may also be used. For example, one end of the single may be crimped or enclosed inside shell 122 such that it does not extend beyond one of the side panels 134. A second end of this embodiment of the single axle still extends beyond the other side panel with a lock as previously described. In this embodiment only the locked end of the single axle extends outside of shell 122. The end of the single axle that is inside of shell 122 includes an extension or other shaped feature that can be used to secure this end of the single inside shell 122.

As shown in FIG. 14, compartment 24 may also include restrictor 140. Restrictor 140 is a portion of compartment 24 that limits the travel of compartment 24 when it is installed into lock box assembly 10, As shown in FIG. 13A, when compartment 24 is rotated to the open position (shown in dashed lines), restrictor 140 contacts ledge 136, This contact between restrictor 140 and ledge 136 limits the rotation of compartment 24 about its axis of rotation, namely the axle positioned in axle hole 126. In the embodiment shown, restrictor 140 is a upstanding flange positioned on a back wall of bin 142 of compartment 24 that extends across the width of bin 142 as shown in FIG. 14. In other examples, restrictor 140 can be a second piece of material that is connected or fixed to bin 142 rather than being a flange of the same material. In still other examples, restrictor 140 is smaller in width and is positioned at a location along the width of bin 142 rather than extending across the width.

Compartment 24 may also include a lock assembly. As shown in FIG. 14A, one example lock assembly is fixed in an opening in face 144 and in bin 142 such that the lock portion extends into the volume of bin 142. The external user interface portion of the lock assembly is positioned on the outward facing surface of face 144 for interaction by the user. Any suitable lock assembly can be used. In one embodiment, a hardened all weather push button electronic locking assembly is used.

Lock box assembly 10 may include other features such as one or more gaskets and expansion points. Referring back to FIG. 14A, one or more gaps may occur between mating components of lock box assembly 10 such as face 144 of compartment 24 and the shell 122. In these gaps or at the contiguous surfaces of mating parts, lock box assembly 10 may include one or more gaskets. The gasket (not shown) is placed in the gaps or between the mating parts to maintain a water-proof seal and/or prevent the intrusion of contaminants into the interior of lock box assembly and into compartments 24. In one example, a gasket is secured around the perimeter of the opening in shell 122 into which a compartment 24 is installed. The gasket may be composed of an elastomeric material such as natural or synthetic rubber, silicone, plastic polymer or the like. The gasket may include a bulb, lip or other compressible feature that compresses when a mating surface is pressed against it such that a seal is created between the gasket and the mating surface. In other examples, a gasket is fit on face 144 at the mating surface of face 144 to shell 122. To additionally prevent the intrusion of contaminants into lock box assembly 10, foam, adhesive, silicone, caulk or other sealing material may be placed in gaps, joints or other intrusion points of lock box assembly 10.

Lock box assembly 10 may also include one or more expansion points. Expansion points are features of lock box assembly 10 that enable additional lock box assemblies (or elements thereof) to be connected to a base lock box assembly to expand the number of compartments available to an end user. For example, as shown in the embodiment of FIG. 12, lock box assembly 10 includes six compartments 24. Lock box assembly 10 may include expansion points on the bottom of lock box assembly 10 such than an additional shell 122 can be fit under the assembly as shown to expand the number of available compartments from six to twelve compartments 24. Expansion points can be of any suitable configuration including holes for attachment of additional shells with fasteners, tabs and mating hangars or the like. The expansion points are configured such that after an additional shell 122, for example, is fit to a base lock box assembly, the additional shell 122 is secured to the base lock box assembly to prevent theft and/or vandalism. Other configurations of expansion points can also be used such as enabling a second lock box assembly to be fit to a base assembly in an end-to-end arrangement so that the additional assembly is co-linear with the base assembly rather than being under the base assembly as previously described.

Figure 16:
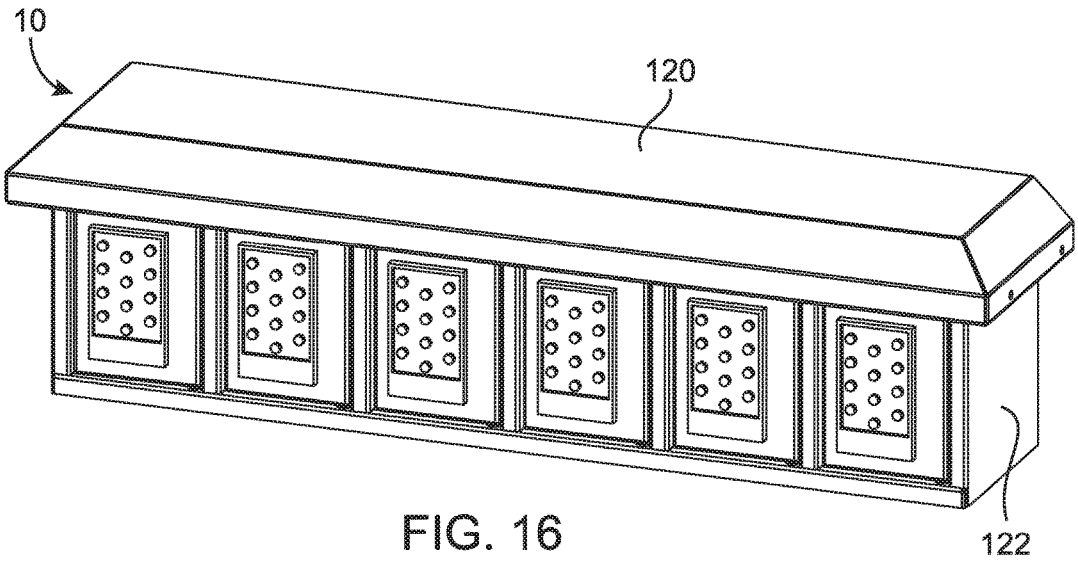
FIG. 16 is an illustration of another embodiment of a lock box assembly of the present disclosure.
Figure 17:
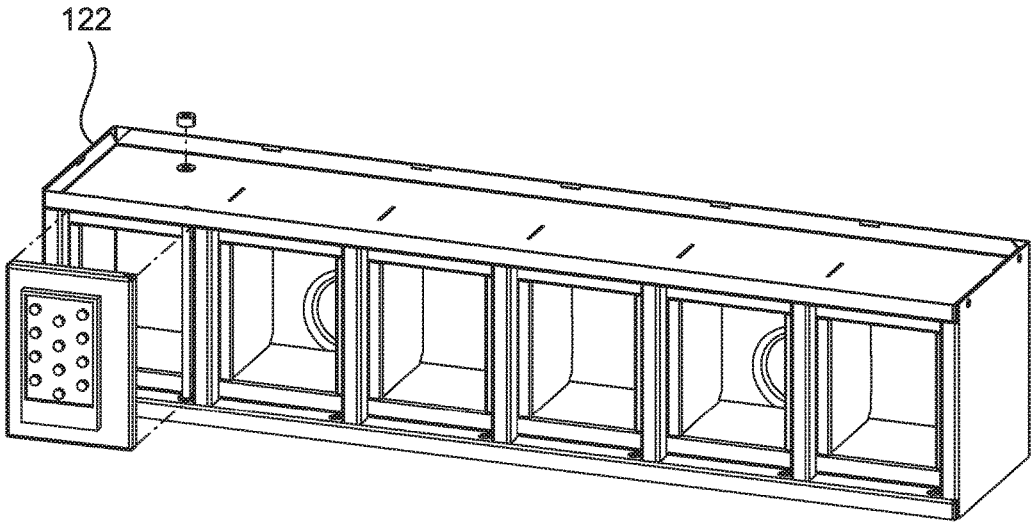
FIG. 17 is an illustration of a shell of the embodiment depicted in FIG. 16.
Figure 18:
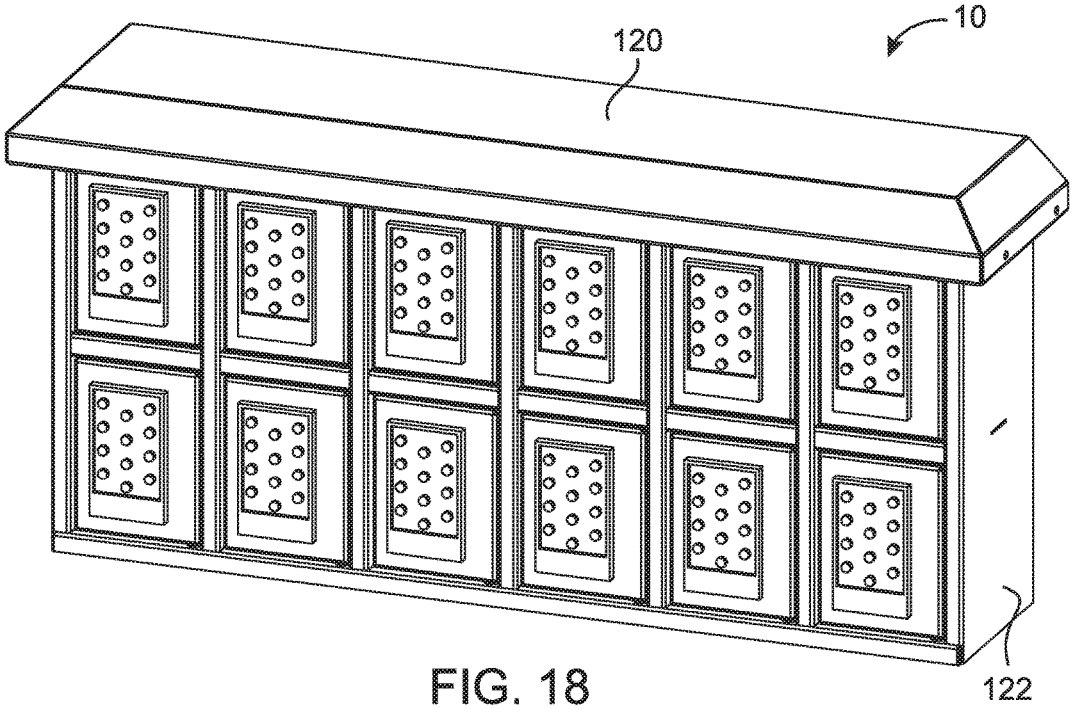
FIG. 18 is an illustration of another embodiment of a lock box assembly of the present disclosure.
Figure 19:
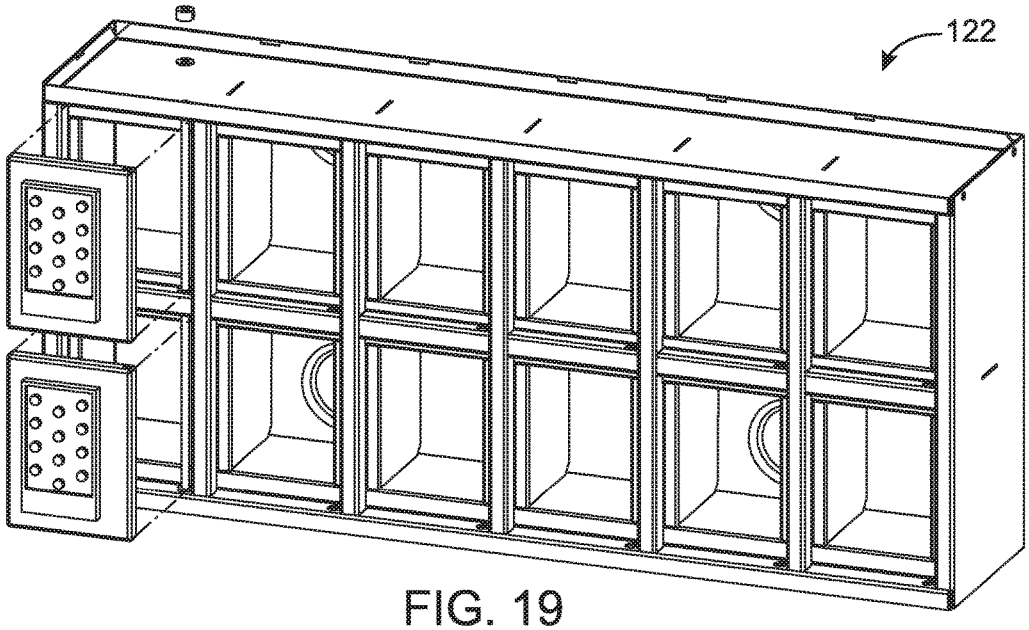
FIG. 19 is an illustration of a shell of the embodiment depicted in FIG. 18.

FIGS. 16-19 show still another embodiment of a lock box assembly of the present disclosure. FIG. 16 shows an embodiment in which lock box assembly includes a single row of compartments while FIG. 18 shows a similar embodiment with a double-stacked row of compartments. As can be seen in FIGS. 17 and 19, in this embodiment shell 122 may be divided into various chambers that serve to hold keys or other items that may be deposited therein by a user for later retrieval. Covering the modules, in this embodiment are doors that are fitted with combination locking mechanisms that further enable the functionality related to the depositing and retrieval of keys or other items.

While the particular preferred embodiments have been shown and described, it is obvious to those skilled in the art that changes and modifications may be made without departing from the teaching of the disclosure. The matter set forth in the foregoing description and accompanying drawings is offered by way of illustration only and not as limitation. The actual scope of the disclosure is intended to be defined in the following claims when viewed in their proper perspective based on the related art.

The invention claimed is:

1. A lock box assembly comprising:

a shell with a first and second opening; and a first compartment connected to the shell in the first opening and a second compartment connected to the shell in the second opening;

wherein the first compartment includes a first bin and the second compartment includes a second bin; and wherein the first bin and the second bin are concurrently rotatable about an axis of rotation to move from an open position to a closed position to hold items in the bin for storage and later retrieval;

wherein the axis of rotation is defined by an axle inserted through the shell and a lower portion of the first and second compartment;

wherein the length of the axle is greater than the length of the shell, such that a first end of the axle extends beyond a side panel of the shell when the second end of the axle is full inserted into the shell; and the first end of the axle includes a lock that engages with a part of the shell when in the locked position.

2. The lock box assembly of claim 1 wherein the lock box assembly includes a single axle is inserted through the first and second compartment and the shell.

3. The lock box assembly of claim 1 wherein the first and second compartment includes a restrictor and the shell includes a ledge, the restrictor and the ledge configured such that when the first and second compartment are moved from the closed position to the open position, the restrictor contacts the ledge to restrict movement of the first compartment and the second compartment.

4. The lock box assembly of claim 1 wherein the shell is formed from a single blank of sheet metal to include a back panel, an upper panel, a lower panel, and two side panels.

5. The lock box assembly of claim 1 wherein the first bin is formed from a single piece of sheet metal to define a volume in which the items can be stored for later retrieval.

6. The lock box assembly of claim 1 further comprising a roof connected to the top of the shell wherein a width of the roof is larger than a width of the shell such that the roof deflects rain away from the first and second compartments.

7. The lock box assembly of claim 1 wherein the first and second compartment include a bin connected to a face, the face including an axle hole in a lower portion thereof in which the axle is inserted to define the axis of rotation.

8. The lock box assembly of claim 1 wherein the first and second compartment are connected to the shell by a single axle.

9. The lock box assembly of claim 1, further comprising:

a bevel including one or more lights located adjacent to the first and second compartments.

10. The lock box assembly of claim 9, further comprising:

a solar panel to provide electrical power to the one or more lights.

11. The lock box assembly of claim 1, further comprising:

an expansion point to couple an additional lock box element to the lock box assembly.

12. The lock box assembly of claim 11, wherein the additional lock box element is a second lock box assembly.

13. The lock box assembly of claim 1, further comprising a first row of compartments and a second row of compartments.

14. The lock box assembly of claim 13, wherein the first row of compartments is stacked horizontally atop the second row of compartments.

15. The lock box assembly of claim 13, wherein the first row of compartments is stacked vertically adjacent the second row of compartments.

16. A method of using a lockbox comprising:

a lock box assembly having a shell with a first and second opening and a first and second compartment connected to the shell;

inserting an axle through the shell and a lower portion of the first and second compartment, wherein the length of the axle is greater than the length of the shell, such that a first end of the axle extends beyond a side panel of the shell when the second end of the axle is fully inserted into the shell;

rotating the first compartment from a closed position to an open position about an axis of rotation defined by the axle;

rotating the second compartment from a closed position to an open position about the axis of rotation while the first compartment is in the open position;

placing an item into a bin of the first compartment and rotating the first compartment and the bin to a closed position while the second compartment is in the open position;

locking the first compartment using a lock assembly connected to the first compartment; and locking a lock on the first end of the axle to a part of the shell.

17. The method of using a lockbox of claim 16, wherein the lock assembly is a push button electronic locking assembly.

18. The method of installing a lock box assembly comprising:

coupling a shell of the lock box assembly to an installation location, the shell including a first and second opening in the shell;

inserting a first and second compartment into the first and second opening in the shell;

inserting a single axle through the shell and through the first and second compartment to movably connect the first and second compartment to the shell, such that the first compartment and the second compartment are concurrently rotatable about the single axle.

19. The method of claim 18 wherein the first and second compartments include a face with two axle holes and a partition between the first and second compartments having an axle hole such that during the step of inserting the single axle, the single axle is inserted through the axle holes on the face of the first and second compartment and the axle hole of the partition to secure the first and second compartment to the shell.

20. A lock box assembly comprising:

a shell having a first opening for housing a first compartment and a second opening for housing a second compartment;

the first compartment having a first door and the second compartment having a second door, wherein the first door and the second door are concurrently rotatable about an axis of rotation to move the first compartment and the second compartment from an open position to a closed position;

wherein the axis of rotation is defined by an axle inserted through the shell and a lower portion of the first and second compartment;

wherein the length of the axle is greater than the length of the shell, such that a first end of the axle extends beyond a side panel of the shell when the second end of the axle is full inserted into the shell; and the first end of the axle includes a lock that engages with a part of the shell when in the locked position.

21. The lock box assembly of claim 20 wherein the first and second door are independently rotatable about the axis of rotation to move the first compartment and the second compartment from the open position to the closed position.

* * * * *